United States Patent [19]

Akiyama

[11] 4,283,700

[45] Aug. 11, 1981

[54] DOUBLE TUBULAR TIME-LAG FUSE HAVING IMPROVED BREAKING CAPACITY

[75] Inventor: Fumitake Akiyama, Yokohama, Japan

[73] Assignee: San-O Industrial Co., Ltd., Tokyo, Japan

[21] Appl. No.: 3,261

[22] Filed: Jan. 15, 1979

[51] Int. Cl.[3] ..... H01H 85/38

[52] U.S. Cl. ..... 337/166; 337/187; 337/248; 337/280

[58] Field of Search ..... 337/163–166, 337/186, 187, 247, 248, 249, 273, 276, 280, 282

[56] References Cited

U.S. PATENT DOCUMENTS

| | | | |
|---|---|---|---|
| 2,135,164 | 11/1938 | Brock | 337/248 |
| 2,773,960 | 12/1956 | Sundt et al. | 337/166 |
| 4,100,523 | 7/1978 | Arikawa et al. | 337/163 |

FOREIGN PATENT DOCUMENTS

| | | | |
|---|---|---|---|
| 595328 | 3/1960 | Canada | 337/248 |
| 681391 | 8/1939 | Fed. Rep. of Germany | 337/273 |

*Primary Examiner*—William H. Beha, Jr.

[57] ABSTRACT

A time-lag fuse with improved breaking capacity is made of double-tubular construction comprising an inner tube made of a material having high thermal conductivity and low thermal impact resistance and an outer tube made of a material with low thermal conductivity but high thermal impact resistance. No arc-quenching material is required and greater safety is afforded when the fuse is subjected to an overload current.

2 Claims, 1 Drawing Figure

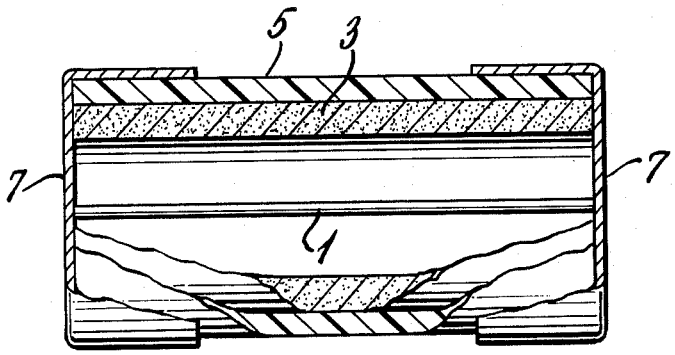
5
3
7
7
1

DOUBLE TUBULAR TIME-LAG FUSE HAVING IMPROVED BREAKING CAPACITY

BACKGROUND OF INVENTION

1. Field of Invention

This invention relates to a time-lag fuse having improved breaking capacity and is particularly related to such a fuse which has a unique double-tubular construction.

2. The Prior Art

It is well known that when an overload current, i.e., current is excess of the rated capacity, flows through a fuse, the fuse may explode resulting in fire hazard due to the drawing of a long arc between the terminals of the fusible wire element which is frequently maintained for a long time. The explosion is often so severe as to cause scattering of fragments of the fuse at a considerable distance, and when the arc is maintained the fuse terminals are destroyed.

It has long been recognized that the adverse effects and impact of the gases resulting from explosion of the fuse may be reduced by the use of so-called "arc-extinguishing" or "arc-quenching" materials. Thus, as disclosed in a very early patent (U.S. Pat. No. 550,638, issued Dec. 3, 1895), the fusible element is surrounded with a loose, porous, non-combustible material such as asbestos, in order to deaden the sound of explosion of the fusible element, prevent fragmentation and scattering, absorb the smoke and resulting gases and confine the destruction of the fusible element to a relatively small portion of its length.

The use of arc-quenching fillers is also mentioned in German Pat. No. 611,680.

More recent patents have also resorted to the use of arc-extinguishing materials for this purpose. For example, U.S. Pat. No. 3,069,520, issued on Dec. 18, 1962 to Cameron et al discloses the use of finely divided inert insulating material such as sand, disposed within the fuse holder and about the fusible element. U.S. Pat. No. 3,876,966, issued on Apr. 18, 1975 to Aloysuis J. Fister also discloses the use of "arc-quenching" filler such as quartz sand, for a similar purpose.

The use of arc-extinguishing fillers in the manner disclosed in the aforementioned illustrative patents to improve the breaking capacity of the fuse has had several disadvantages. As disclosed in the recent patent of Arikawa et al (U.S. Pat. No. 4,100,523, issued on July 11, 1978), it is difficult to stabilize the fuse characteristics when the fuse is filled with arc-extinguishing material as in the prior art. This is due to irregularities in the grain distribution of this material and variations in its filling rate. Moreover, a large amount of heat conduction from the fusible element to the arc-extinguishing material causes changes in the thermal balance of the fusible element and impairs the time-lag characteristic of the fuse and, at the same time, heat conduction from the fusible element to the arc-extinguishing material, and then to the fuse tube, tends to raise the temperature of the fuse tube excessively. These and other disadvantages impair the breaking capacity and time-lag properties of the fuse.

It is therefore an object of this invention to provide a fuse which has an improved breaking capacity and time-lag characteristics.

It is another object of this invention to provide a fuse with improved breaking capacity and time-lag characteristics which is free from the difficulties and disadvantages which are inherent in the prior art fuses employing arc-quenching materials.

The foregoing and other objects of this invention will be more clearly understood from the following detailed description of the invention, taken in conjunction with the accompanying drawing which is a longitudinal sectional view of a double-tubular fuse constructed in accordance with this invention.

SUMMARY OF INVENTION

A time-lag fuse having improved breaking capacity is provided which comprises an inner tube made of a material having high thermal conductivity and low thermal impact resistance and an outer tube having low thermal conductivity and high thermal impact resistance.

When an overload current flows through the fusible element which is stretched between the ends of the inner tube and an electric arc is generated across the terminals of the fuse, the inner tube is fragmented and the resulting heat and vapors will be absorbed by the fragmented parts. However, since the outer tube is of high thermal impact resistance, it will not be fragmented and the fragmented pieces of the inner tube will remain within the outer tube rather than scatter about. Fire hazard is therefore eliminated and safe operation of the fuse is insured by this unique double tubular structure.

DETAILED DESCRIPTION OF INVENTION

It has now been discovered that the disadvantages inherent in fuses which contain art-quenching fillers in the fuse tube can be eliminated by a novel and unique fuse construction which does not require the use of arc quenching fillers. Yet, the fuse of this invention exhibits excellent breaking capacity and time-lag behavior, and an overload current can be interrupted in a fraction of a second without explosion of the tube and while maintaining the stability of the fuse.

Referring now to the drawing, the novel fuse comprises a fusible element 1, such as a conductor metal wire and the like, disposed within an inner tubular member 3 which is, in turn, disposed within an outer tubular member 5 which is coterminus with the inner tubular member. The ends of the tubular members are capped with a pair of ferrules 7, 7 to seal the double-tubular fuse while maintaining electrical contact with the fusible element. The fusible element is thus disposed within the empty tubular member 3 and no arc-quenching filler is employed.

For reasons which are hereinafter explained, the inner tubular member 3 must be made of a material which has a high thermal conductivity but low thermal impact resistance so as to be fragmented when an overload current is passed through the fusible element 1. On the other hand, the outer tubular member 5 must be made of a material which has a low thermal conductivity but high thermal impact resistance to withstand fragmentation. Thus, when an overload current flows through the fuse and an electric arc is generated across the fusible element 1, this element will melt and generate metal vapors in the tubular member 3, as in the prior art fuses. However, and unlike the prior art fuses, the metal vapors and the heat generated in the tubular member are not absorbed by arc-quenching fillers, but rather, the electric arc and the resulting heat will cause fragmentation of the inner tubular member 3 since, as it was previously mentioned, the inner tube is made of material which has high thermal conductivity but low impact resistance. Once the inner tube is fragmented, the electric arc and metal vapors will diffuse into the gaps and spaces between the broken and fragmented pieces and the vapor is thus cooled down. The electric arc energy is accordingly consumed in the inner tube causing a rapid rise in the inter-electrode voltage, and the current is quickly interrupted.

Since the outer tubular member 5 is made of a material of high thermal impact resistance but low thermal conductivity, the outer tubular member withstands fragmentation under the aforementioned conditions, and the fragmented inner tubular member will thus be confined within the outer tube. There is, therefore, no likelihood of fragmentation and scattering of the tube, nor is there the danger of fire hazard as in the prior art fuses where hot, fragmented pieces of the fuse tube are scattered about the surrounding environment.

Although several materials suggest themselves to one skilled in the art on the basis of the disclosure and requirements set forth for the construction of the inner and outer tubes of the fuse of this invention, nevertheless, and by way of examples, it has been found that ceramic materials such forsterite, steatite and talc are eminently suitable for the construction of the inner tube, while cordierite and lithium ceramics constitute excellent materials of construction for the outer tubular member. Again, it must be emphasized that these materials are merely examplary and are not intended to be all inclusive.

The properties of forsterite used in making the inner tube and cordierite used in making the outer tube are given in the following table:

| Material Composition, Wt. % | Forsterite | Cordierite |
|---|---|---|
| $2MgO \cdot SiO^2$ | 99.5 | — |

-continued

| Material Composition, Wt. % | Forsterite | Cordierite |
|---|---|---|
| $2MgO \cdot 2Al_2O_3 \cdot 5SiO_2$ | — | 99.3 |
| $K_2O$ | 0.12 | 0.50 |
| $Na_2O$ | 0.38 | 0.20 |
| Specific Gravity | 2.87 | 2.40 |
| Thermal Expansion Coefficient | $10.5 \times 10^{-6}$ | $3.2 \times 10^{-6}$ |
| Thermal Conductivity, Cal . cm/cm$^2$ . sec. °C. | 0.0082 | 0.0045 |
| Bending Strength, kg/cm$^2$ | 1470 | 1260 |
| Softing Point, °C. in air | 1350 | 1380 |
| % Water Absorption | 0.000 | 0.000 |
| Electrical Resistance Value | $2.5 \times 10^7$ | $7.2 \times 10^7$ |

Thus, in accordance with this invention, a unique fuse construction is provided which dispenses with filling the fuse tube with arc-quenching materials and which affords excellent arc-interrupting characteristic with increased safety of operation.

What is claimed is:

1. A time lag fuse having improved current-interrupting characteristics which comprises an inner tubular member, an outer tubular member encasing said inner tubular member and coterminous therewith, a fusible element disposed between the ends of said inner tubular member and means for enclosing the ends of said tubular members while establishing electrical contact with said fusible element, said inner tubular member being made of a material selected from the group consisting of fosterite, steatite, talc, or mixtures thereof having high thermal conductivity and low thermal impact resistance so as to be fragmented by the passage of an overload electrical current through said fusible element, and said outer tubular member being made of a material selected from the group consisting of cordierite ceramic, lithium ceramic, or mixtures thereof having low thermal conductivity and high thermal impact resistance to resist fragmentation during the passage of said overload electrical current.

2. A time lag fuse as in claim 1 wherein said means for enclosing the ends of said tubular members is ferrules.

* * * * *